US005960600A

United States Patent [19]

Monaco

[11] Patent Number: 5,960,600

[45] **Date of Patent: *Oct. 5, 1999**

[54] CARPET-COVERED BASEBOARD AND METHOD OF USE THEREOF

[76] Inventor: John A. Monaco, 7803 Brentwood Dr., Anchorage, Ak. 99502

[ * ] Notice: Under 35 U.S.C. 154(b), the term of this patent shall be extended for 123 days.

[21] Appl. No.: 08/540,193

[22] Filed: Oct. 6, 1995

[51] Int. Cl.[6] ..... E04F 11/16; A47G 27/04

[52] U.S. Cl. ..... 52/287.1; 52/288.1; 52/718.04; 52/273; 16/7; 16/16

[58] Field of Search ..... 52/287.1, 288.1, 52/273, 716.1, 716.4, 718.01, 718.04; 16/4–7, 16

[56] References Cited

U.S. PATENT DOCUMENTS

| | | | |
|---|---|---|---|
| 1,503,929 | 8/1924 | Tracy et al. | 52/288.1 X |
| 1,555,392 | 9/1925 | Tracy et al. | 52/288.1 X |
| 2,506,030 | 5/1950 | Mapes | 16/7 |
| 2,587,836 | 3/1952 | Goodemoot | 16/16 |
| 2,994,905 | 8/1961 | Franker, Jr. | 52/288.1 X |
| 3,092,869 | 6/1963 | Stump | 52/288.1 X |
| 3,201,909 | 8/1965 | Grun | 16/7 X |
| 3,286,422 | 11/1966 | Pangerl | 16/7 X |
| 3,464,177 | 9/1969 | Amato | 52/288.1 |
| 3,475,871 | 11/1969 | Saunders et al. | 52/288.1 X |
| 3,514,914 | 6/1970 | Bergquist | 16/4 X |
| 3,549,471 | 12/1970 | Denton | 52/287.1 X |
| 4,058,946 | 11/1977 | Habrant | 16/16 X |
| 4,730,432 | 3/1988 | Schafer et al. | 52/287.1 X |

FOREIGN PATENT DOCUMENTS

| | | | |
|---|---|---|---|
| 2608194 | 6/1988 | France | 16/7 |
| 0857025 | 12/1960 | United Kingdom | 16/7 |

*Primary Examiner*—Carl D. Friedman
*Assistant Examiner*—Winnie S. Yip
*Attorney, Agent, or Firm*—Michael J. Tavella

[57] ABSTRACT

A system for attaching carpet to a wall. This system uses a lightweight form body to support a strip of carpet. The form body is curved and the carpet is curled over the form. The form body can have a number of different profiles, depending on the look desired and the material being used. The form body is attached to the floor or the wall using common fasteners. Two special mitered corner pieces are included-one for an inside corner and one for an outside corner. To fit a corner, the length is measured and a straight cut is made across the corner piece. The mitered end that has been removed can be turned to fit against the factory made miter end to complete the corner. To facilitate installation, a special tool is included that is marked in feet. A 45° miter is included in the center of the tool to score the carpet for miters. A second 45° arm is included to make outside cuts as needed.

7 Claims, 15 Drawing Sheets

CARPET-COVERED BASEBOARD AND METHOD OF USE THEREOF

This invention relates to carpet-covered baseboard and the method of construction thereof.

BACKGROUND 0F THE INVENTION

For years, finish construction of homes has relied on three main types of floor coverings: wood, tile and carpet. Of all of these types of coverings, wall-to wall carpet has become ubiquitous in tract-style homes. The typical treatment to finish the area where the carpet on the floor contacts the bottom of a wall is to conceal the junction with molding, typically a wood product. In many commercial buildings, moldings include running a few inches of carpet up the lower portion of the wall. Examples of such treatments are found in U.S. Pat. Nos. 1,503,929, 1,555,392, 2,994,905, 3,092,869, 3,475,871, and 3,514,914. A common feature of all of these treatments is that they use molding forms to support the carpet. In all the patents listed above, the molding forms cover the top of the carpet in some manner. Thus, in looking at any of these treatments described in the above mentioned patents, a length of carpet running is run up a wall, and capped by some type of cover. Although these treatments are common and present a good appearance, once they are in place, it is difficult to remove the carpet for cleaning or replacement without damaging or replacing the underlying forms.

Some installations use molding form and the carpet is simply folded over on top of the molding form and stapled in place. This type of installation is not good because it does nothing to finish the end of the carpet. Also, in this treatment, the staples tend to show, that creates a shabby appearance.

SUMMARY OF THE INVENTION

The instant invention is another system for attaching carpet to a wall. As the methods described above, this method uses a lightweight form body to support the carpet. Unlike the methods above, which use caps to cover the top of the carpet, the instant invention curls the carpet over the top of the form body, thereby producing a finished look without added components and without extra time and labor. The invention uses lightweight wire mesh, plastic, wood, cardboard, plastic foam, rubber or pressboard to make a form body to support the carpet. The form body can have a number of different profiles, depending on the look desired and the material being used. The form body is attached to the wall or the floor using common fasteners, or adhesives.

To install the carpet, the carpet is first laid against the form body. Then the top of the carpet strip is bent over the upper surface of the form body and tucked into a receiving space in the form body. This receiving space is different for different style form bodies. The lower end of the carpet strip is tucked under the form body, in-between the underlying floor carpet and the form body. This presents a neat, finished look for the wall base that is presents a unique visual appearance. Moreover, because there is no cap over the carpet, the carpet strips can be quickly and easily removed, cleaned, and reinstalled.

The frames can be made in flat strips in any length desired. To form corners, two options are available. First, special corner pieces are provided-one for an inside corner and one for an outside corner. Each piece has two mitered ends. To fit a comer, the desired length is measured and a straight cut is made across the corner piece. The mitered end that has been removed can be turned to fit against the factory made miter end to complete the corner. This technique can be used on either an inside of an outside corner. Second, in the case of the foam or plastic form bodies, corner pieces can be molded in one piece. Two parts are provided: an inside comer and an outside corner.

Finally, for curved surfaces, the form bodies can be bent to fit the curves by cutting kerfs in the form to make the form flexible. The form bodies can be cut as needed to fit whatever curve is encountered.

To facilitate installation, a special tool is provided that is marked in feet. A 45° notch is provided in the center of the tool to score the carpet for miters. A second 45° arm is provided to make outside cuts as needed.

It is an object of this invention to produce a form body for supporting lengths of carpet that does not need a top cap to finish the look.

It is another object of this invention to produce a form body for supporting lengths of carpet that has pre-formed inside and outside angle components.

It is yet another object of this invention to produce a form body for supporting lengths of carpet that has mitered inside and outside angle components than are field assembled.

It is a further object of this invention to produce a form body for supporting lengths of carpet that includes an installation tool for making necessary cuts for installation.

It is yet a further object of this invention to produce a form body for supporting lengths of carpet that can be made from a variety of materials using a number of different fabrication techniques.

It is another object of the invention to produce a form body for supporting lengths of carpet that permits the carpet for cleaning without having to remove the form body.

DETAILED DESCRIPTION OF THE INVENTION

Figure 1:
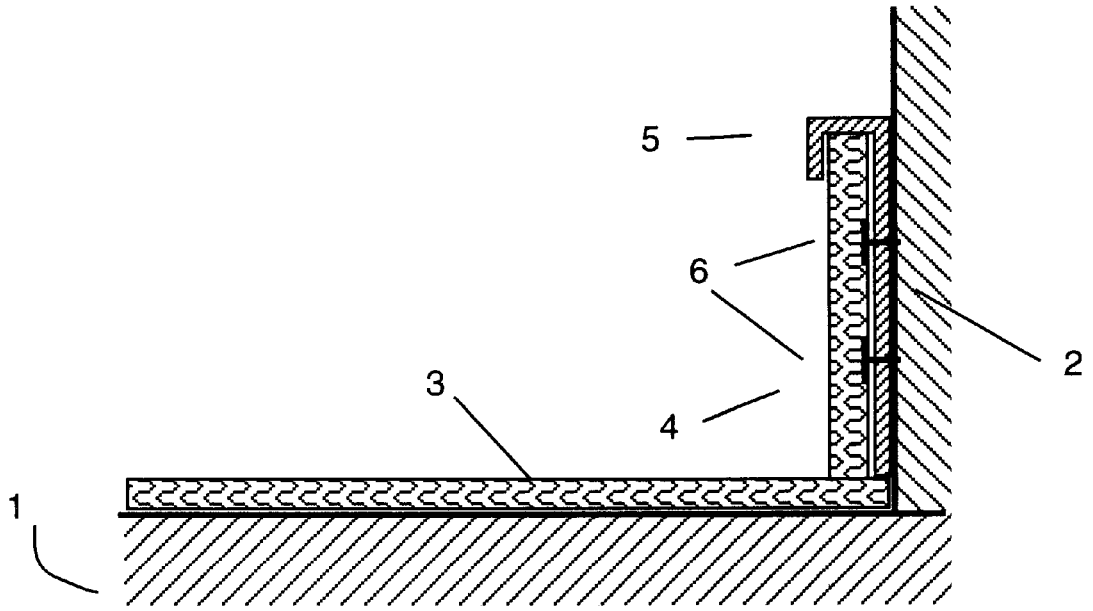
Figure 1 Prior Art
FIG. 1 is a cross-sectional view of a typical wall board carpet finish as prior art.

Referring now to FIG. 1, one type of prior-art carpet baseboard system is shown. In this system, there is a floor 1, a wall 2, a floor carpet 3 that is run up against the wall 2 as shown. A baseboard carpet piece 4 is supported by a formed backboard 5. The backboard 5 is secured to the wall 2 by fasteners 6 as shown. One characteristic of most of the prior art devices is that the backboard 5 typically covers the carpet piece 4 as shown.

Figure 2:
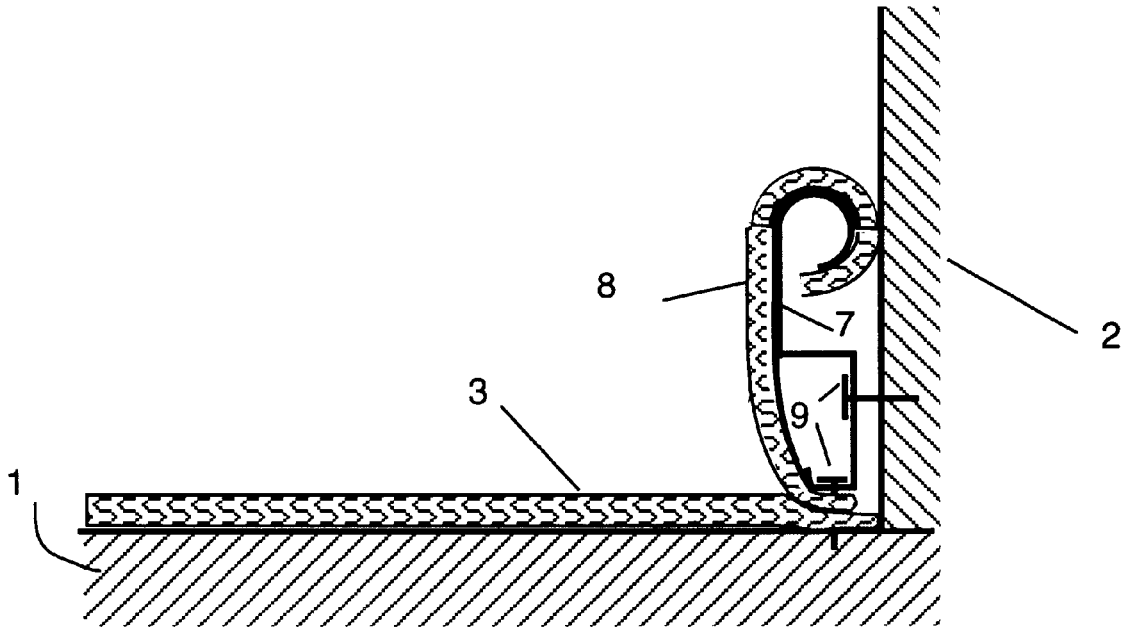
FIG. 2 is a cross-sectional view of a typical wall-board carpet finish using one form of my new invention.

Referring now to FIG. 2, one embodiment of the instant invention is shown. In this embodiment, the floor 1, the wall 2, and the floor carpet 3 are the same as before. Instead of the backboard 5, however, a form body 7 is used to support the carpet piece 8. As shown, the form body 7 is secured to the wall 2 by fasteners 9. The fasteners can be either nails, screws, or similar fastener, or can be an adhesive strip 78 placed on the form body 7 (see FIGS. 11 and 18). Unlike the prior art, the carpet piece 8 is folded over the top of the form body 7 as shown. This presents a clean, pleasing, uniform appearance. The bottom of the carpet piece 8 is tucked under the form body 7 between the form body 7 and the floor carpet 3. The bottom 101 of the form body 7 is curved as shown, to accommodate fitting the carpet being tucked under the form body 7 as discussed above. Besides producing a neat appearance, the carpet piece 8 can be readily removed from the form body 7 for cleaning and easy reinstalled. The prior art devices mentioned above do not permit the baseboard carpet piece 8 to be easily removed or replaced without undoing the entire installation.

Figure 3:
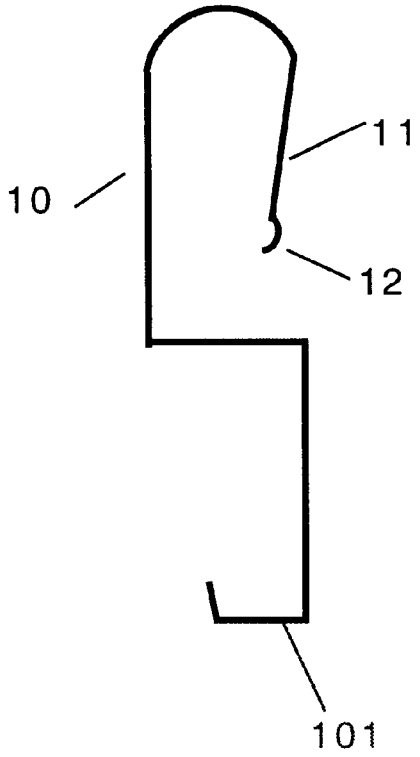
FIG. 3 is a profile view of one embodiment of my carpet support form.
Figure 4:
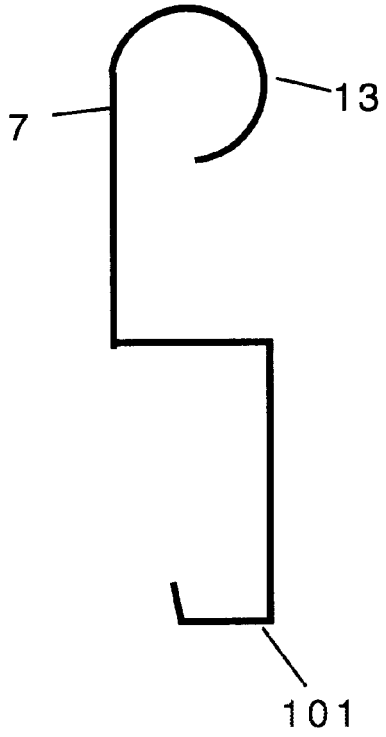
FIG. 4 is a profile view of another embodiment of my carpet support form.
Figure 5:
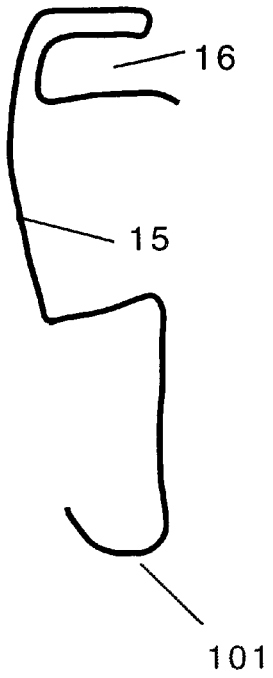
FIG. 5 is a profile view of another embodiment of my carpet support form.
Figure 6:
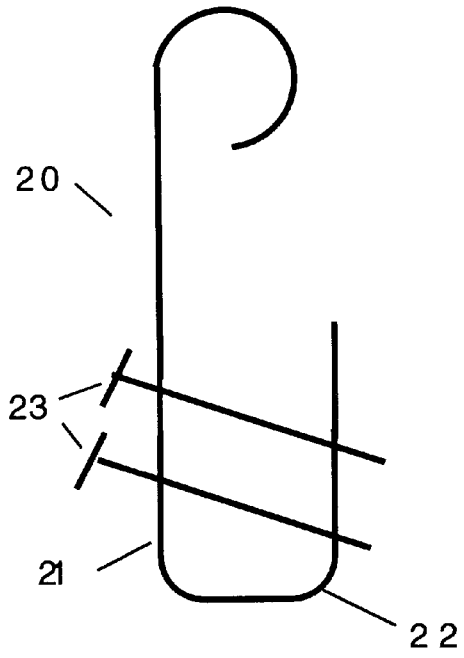
FIG. 6 is a profile view of another embodiment of my carpet support form.
Figure 7:
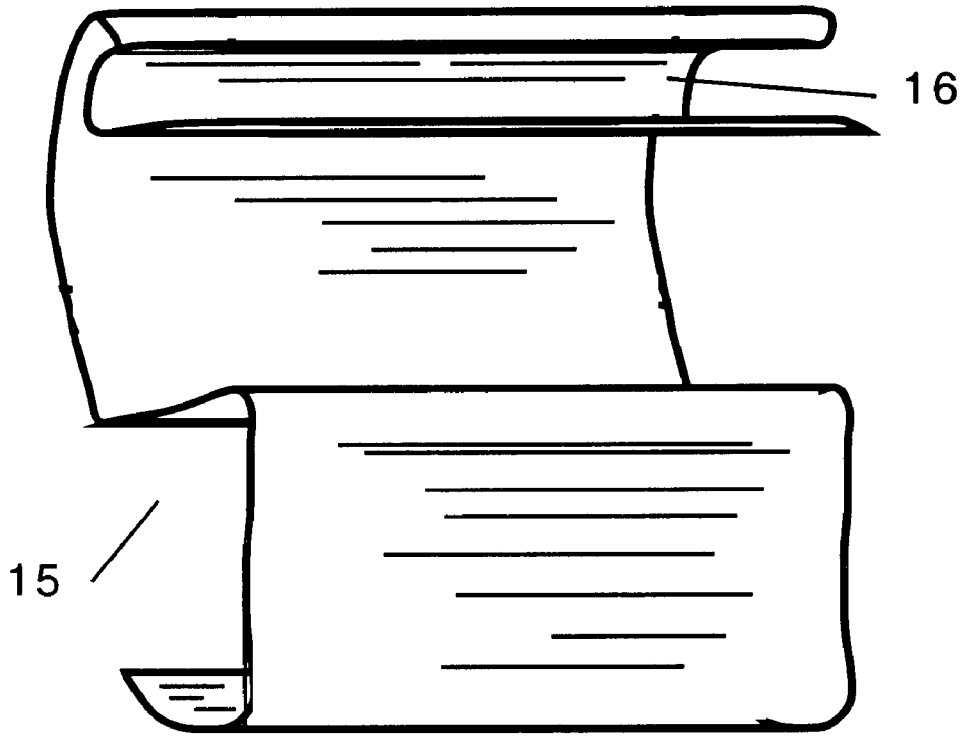
FIG. 7 is a perspective view of the carpet support form of FIG. 5.

In the preferred embodiment, the form body 7 is made of lightweight materials such as wire mesh, plastic, wood, cardboard, plastic foam, rubber or pressboard. Moreover, the form body 7 can have many different form bodies such as those shown in FIGS. 3–10. FIG. 3 shows a form body 10 that has an elongated back arm 11 and a hooked end 12. FIG. 4 showed the form body 7, having a simple curved back arm 13. FIG. 5 shows another embodiment 15 that has a more angled form as well as a holding pocket 16, formed as shown, instead of a back arm. FIG. 6 shows another embodiment 20. In this embodiment, the front edge 21 extends to the bottom of the form body 20 as shown. The lower portion 22 of the form body 20 then curves upward. This allows fasteners 23 to be run through the form body 20 that can be hammered directly into a wall 2. This type of design can speed up installation of the form body 20 because the fasteners are much more accessible. FIG. 7 shows the embodiment of FIG. 5 in a perspective view to show how a length of this material would look. The form bodies are designed to come is standard straight lengths of five to ten feet.

Figure 8:
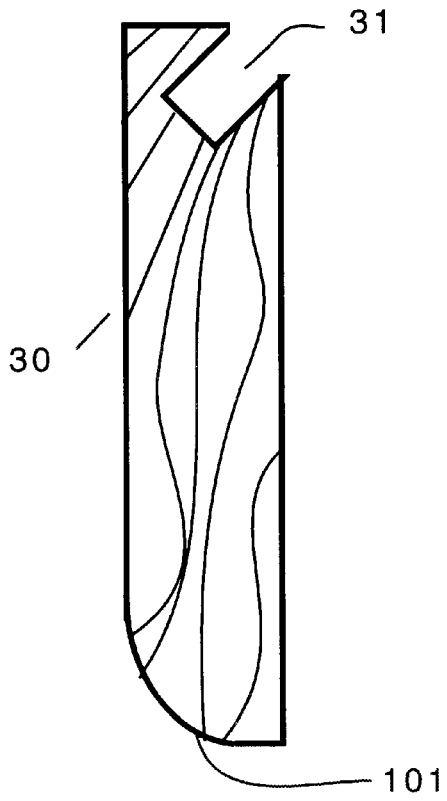
FIG. 8 is a profile view of another embodiment of my carpet support form.
Figure 9:
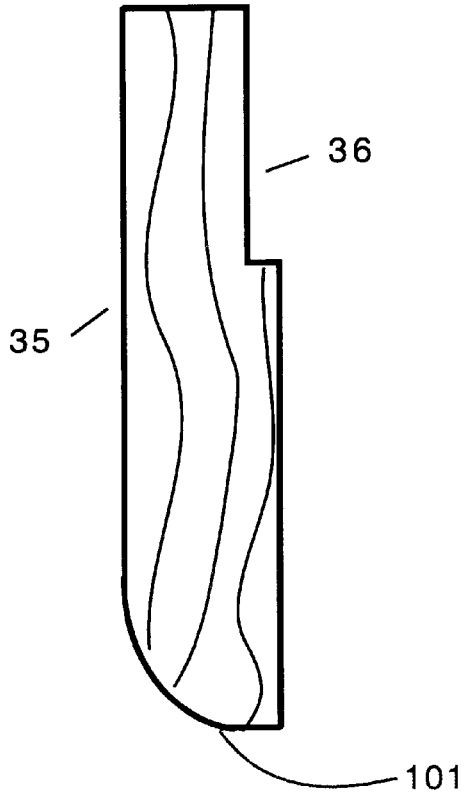
FIG. 9 is a profile view of another embodiment of my carpet support form.
Figure 10:
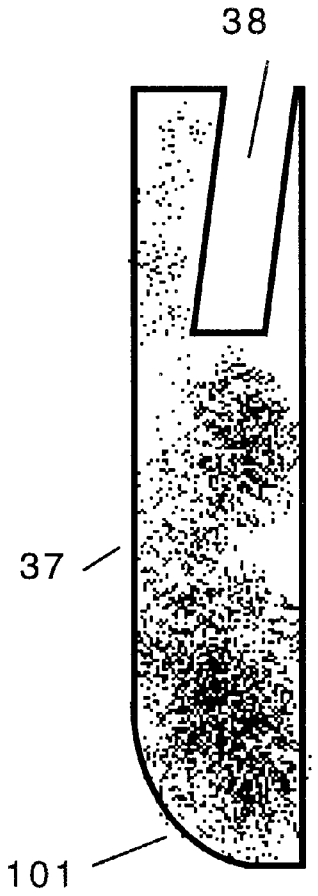
FIG. 10 is a profile view of another embodiment of my carpet support form.
Figure 11:
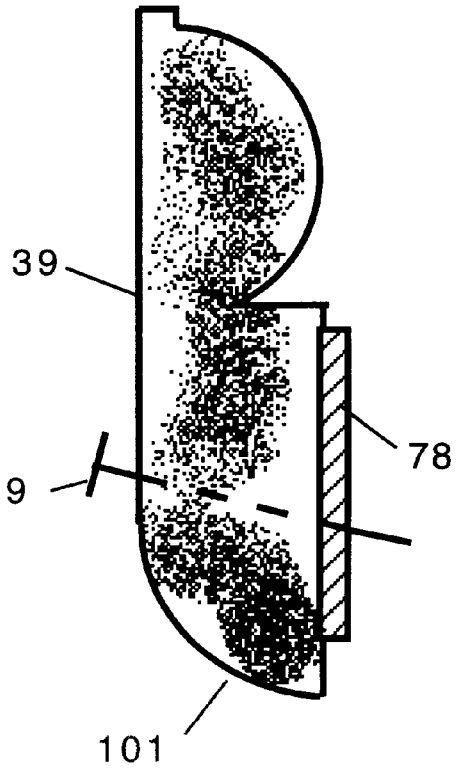
FIG. 11 is a profile view of another embodiment of my carpet support form.

FIGS. 8–10 show a different set of form body embodiments. In these embodiments the form bodies are rectangular and can be made of extruded plastic or wood. FIG. 8 shows form body 30. This embodiment has a notch 31 cut at an angle to receive the carpet piece 8. FIG. 9 shows a form body 35 that has a rabbit 36 cut in the back surface to receive the carpet piece 8. FIG. 10 is a form body 37 that has a notch 38 as shown. FIG. 11 is a profile of a form body 39 made from extruded plastic foam or hard plastic. These embodiments are the best for using adhesive backing for mounting as they have a large surface area in contact with the wall 2. See, e.g., FIGS. 11 and 18.

Figure 12:
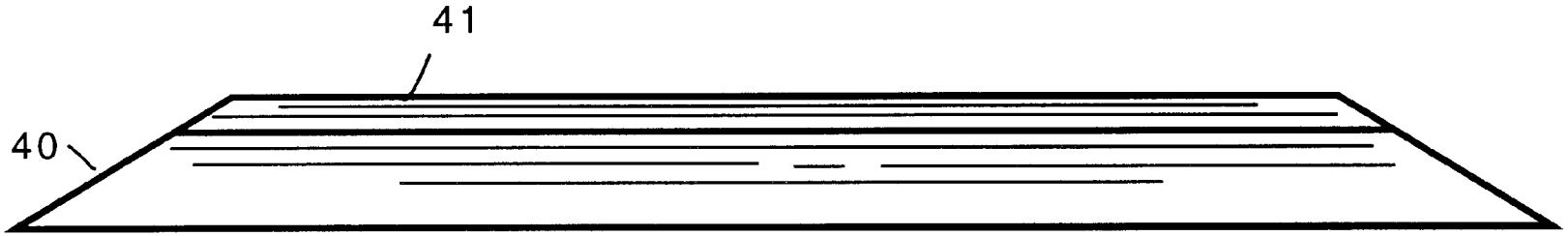
FIG. 12 is a top view of the outside corner piece.
Figure 13:
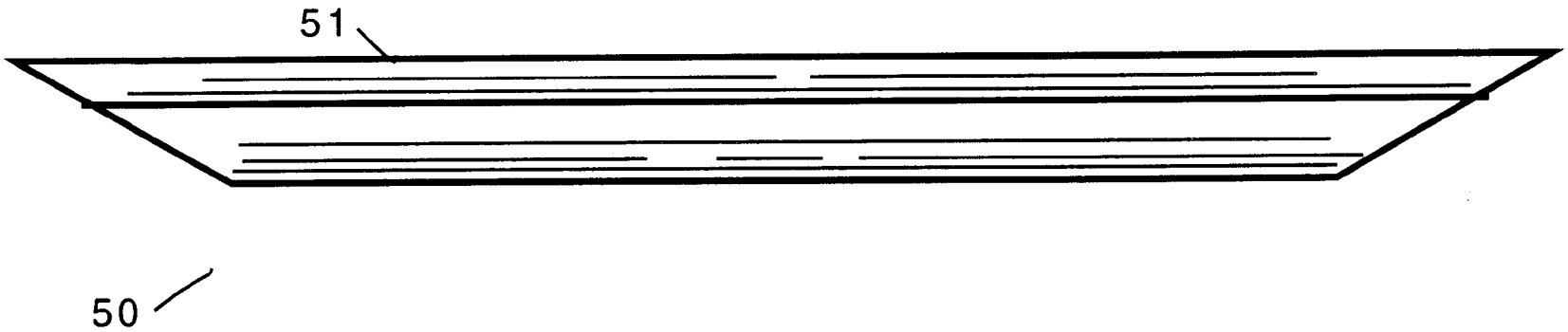
FIG. 13 is a top view of the inside corner piece.
Figure 14:
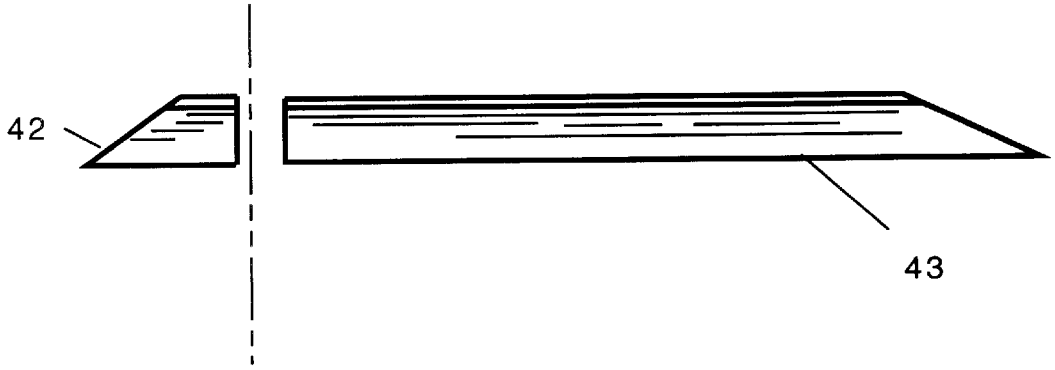
FIG. 14 is a top view of the outside corner piece cut for forming a corner.
Figure 15:
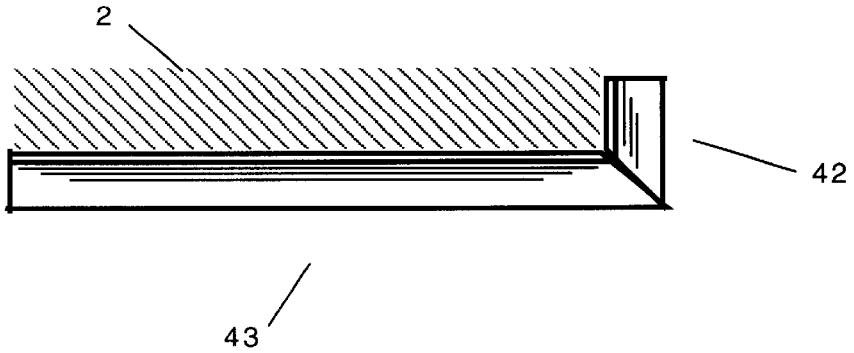
FIG. 15 is a top view of a completed outside corner.
Figure 16:
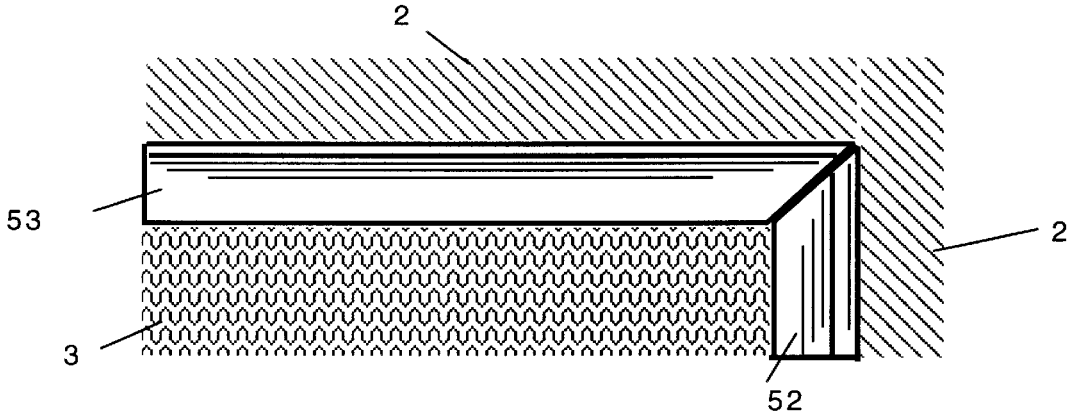
FIG. 16 is a top view of a completed inside comer.

FIGS. 12–16 show the components for making comer angles. FIG. 12 is an outside comer form body 40 which can be considered as a means for extending the baseboard support form around an outside corner of a wall. This form body is about 12 inches long in the preferred embodiment. The comer form body 40 has the carpet piece retainer 41 as shown. FIG. 13 shows the inside corner form body 50, which can be considered as a means for extending the baseboard support form around an outside corner of a wall. This form body 50 has the carpet retainer 51 as shown. Note the placement of the mitered edges with respect to the carpet piece retainers 41 and 51 on the respective corner form bodies. FIGS. 14–16 show how comers are fitted. FIG. 15 shows the completed outside corner 40. To form a comer, a length of the comer form 42 is cut as shown in FIG. 14. The remaining piece 43 is then butted up against the straight form body 7 (or any other corresponding embodiment). The piece 43 is then secured to the wall 2 as shown. The cut piece 42 of the corner form 40 is then placed as shown against the wall 2 that is around the corner from the piece 43. See FIG. 15. The edges are then butted up together and the pieces are finally fastened. The next straight run of form body 7 (or any other embodiment) can then be butted up against the cut piece 42, and a new run can begin.

The same technique can be used for an inside corner using corner piece 50 as shown in FIG. 16. Pieces 52 and 53 are formed and placed in the same manner as pieces 42 and 43 for the outside corner.

Figure 20:
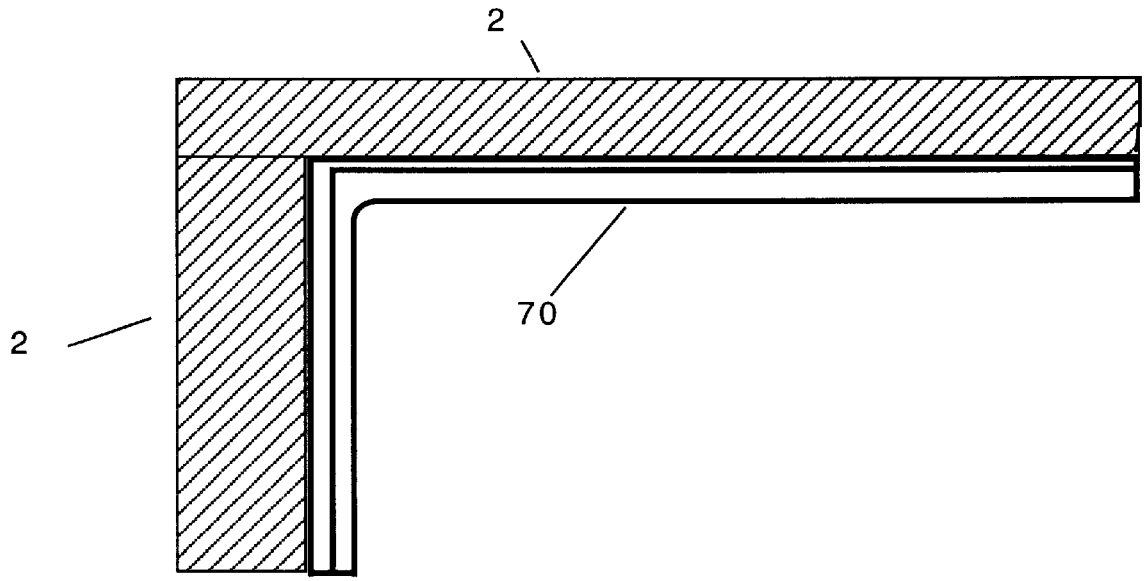
FIG. 20 is a top view of a pre-formed inside corner.
Figure 21:
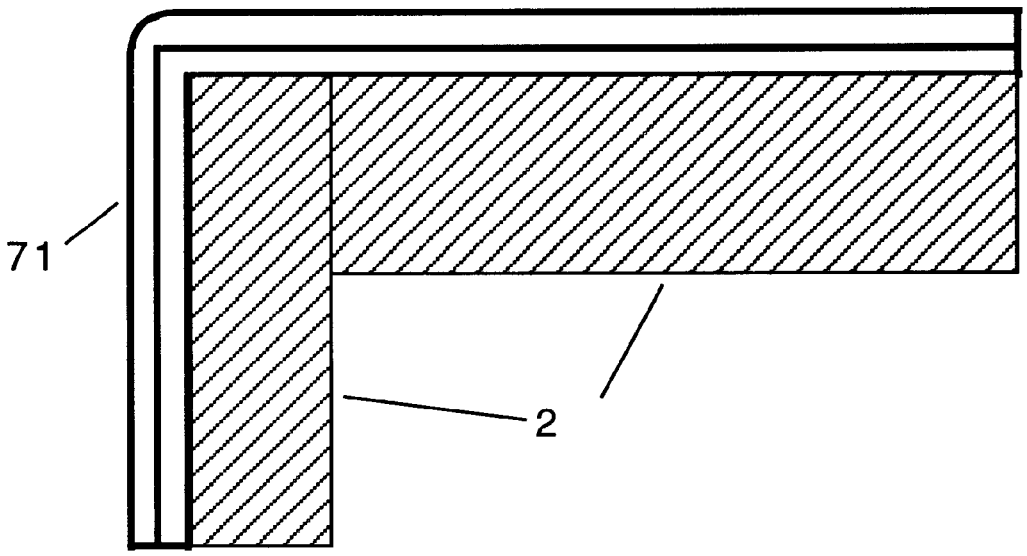
FIG. 21 is a top view of a pre-formed outside corner.

Alternatively, the corner sections can be pre-formed from plastic, wood, foam or other materials. FIG. 20 shows the pre-formed inside corner 70. FIG. 21 shows the pre-formed outside comer 71. Unlike the mitered corner pieces, the pre-formed pieces 70 and 71 are installed by placing the pieces on the corner, trimming the ends to fit, and securing the pre-formed pieces 70 or 71 to the wall 2. Pieces 70 and 71 can be considered as a means for extending the baseboard support form around an outside corner of a wall.

Figure 19:
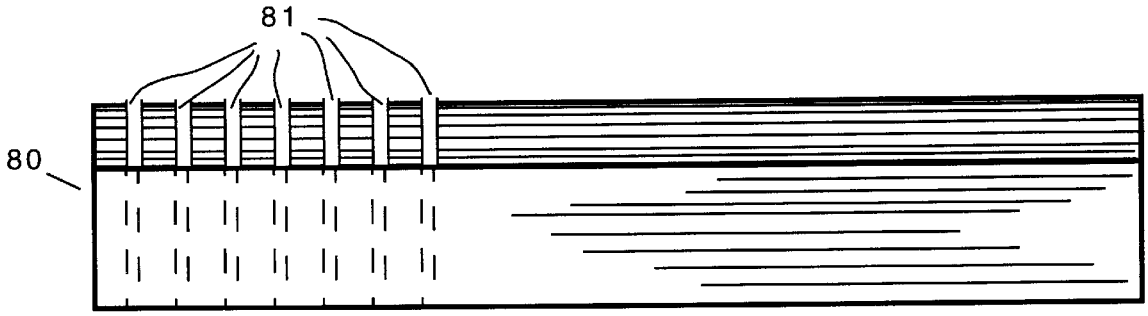
FIG. 19 is a rear view of a form cut to fit a curved wall.

In the case of a curved wall, the form of FIG. 19 is used. Here, the form 80 has a number of kerfs 81 cut into the form 80 as shown. These kerfs allow the form to bend without breaking. The number of kerfs 81 depends on the curve to be covered. Any needed field cuts can be easily made using tools and techniques well know in the art.

Figure 17:
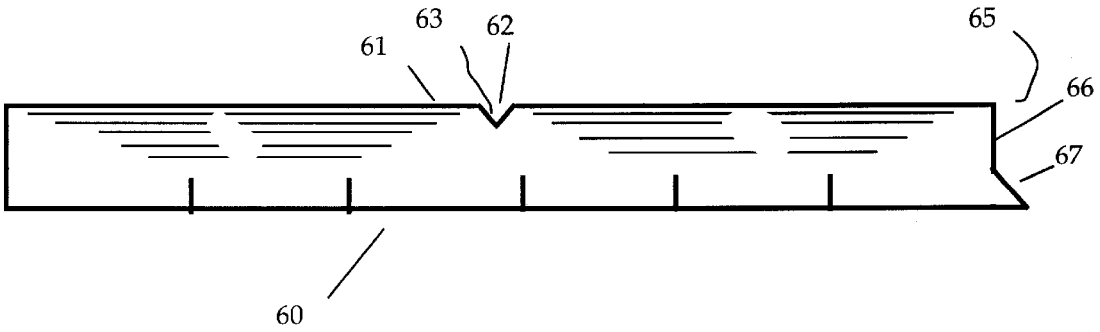
FIG. 17 is a top view of the marking tool for cutting the carpet strips.

Once the form body 7 is in place, the carpet piece 8 must be installed. The carpet piece 8 has a height of about four inches and can be cut from remnants of the floor carpet. This reduces waste and ensures an exact color match. The carpet piece 8 is cut to length and fitted over the form body 7 as discussed above. At corners, the carpet piece 8 must be cut to be able to bend around the corners. To ensure this is done properly, a special measuring tool 60 is used. See FIG. 17. In the preferred embodiment the tool 60 is six feet long and five inches wide. Of course, the tool 60 can be films,,any suitable dimension; however, the dimensions mentioned above are preferred. In the center of one edge 61 of the tool 60, there is a 45 degree notch 62 that has one inch lengths 63 as shown. This notch 62 is used for cutting outside comers in the carpet pieces 8. On one end 65 of the tool 60 is an edge for cutting inside comers. This edge has a four-inch straight edge portion 66 and a one-inch 45 degree point 67 as shown. A carpet piece 8 can be placed under this edge 65, aligned, and cut using the guide, to form an inside corner.

Once installed, the carpet can be removed for cleaning by simply pulling it out of the mold forms. Once removed, it can be cleaned and reinstalled by following the original installation procedures.

Figure 18:
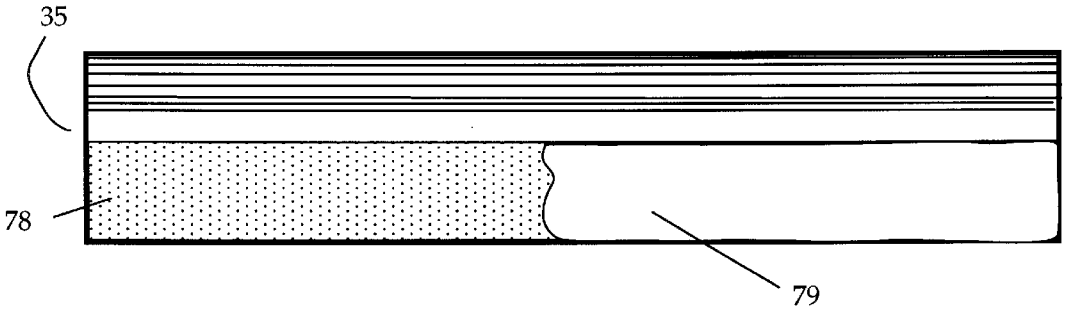
FIG. 18 is a rear view of the invention showing the placement of an adhesive strip as an alternative fastener for the device.

Referring now to FIG. 18, as discussed above, an alternative fastening means is disclosed (see also FIG. 9). In this embodiment, a form body, such as form body 35 of FIG. 9 is shown. On the back side 37 of the form body 35 is a self-adhesive strip 78. This strip is preferably rectangular and has a suitable adhesive for mounting the material, either plastic or wood, to the wall 2. In the preferred embodiment, this adhesive strip 78 has a removable paper cover 79 that can be quickly removed when the form body 35 is ready to install. In place of the preattached strips, the adhesive can be installed in any number of ways common to the art: by brush, caulk gun, etc. Several thin strips can be used in place of one thick strip. The techniques can vary considerably and are not limited to only that which is shown here. Of course, any embodiment mentioned above can be modified using adhesive strips in the same manner.

All of the embodiments shown have a curved bottom 101 to allow the carpet to be pushed under the curved bottom, between the floor carpet and the form body. This technique is discussed above in the discussion of form body 7, and applies to all the form bodies shown.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A baseboard support form system, for use with a carpet strip, a wall and a floor, the floor having a layer of carpet thereon, comprising:

a) a form body, made of bendable material, said form body including a face side, and a back side, and a curved upper surface for supporting said carpet strip, said curved upper surface having a generally semi-circular form, thereby permitting said carpet strip to be bent thereover;

b) a groove formed in said back side to receive said carpet strip, thereby removably securing said carpet strip therein;

c) a curved lower surface permitting said carpet strip to be curved thereunder, thereby securing said carpet strip between said form body and said floor; and d) a means for securing said form body to said wall.

2. The baseboard support form system of claim 1 wherein the means for securing said form body to said wall comprises a plurality of nails drivably installed in said form body.

3. The baseboard support form system of claim 1 wherein the means for securing said form body to said wall comprises an adhesive strip fixedly attached to said form body for gluing said form body to said wall.

4. The baseboard support form system of claim 1 wherein the wall has a length, and forms inside and outside corners, said baseboard support form system further comprising:

a) means for extending said baseboard support form system around an inside corner of said wall; and b) means for extending said baseboard support form system around an outside corner of said wall.

5. The baseboard support form system of claim 4 wherein the means for extending said baseboard support form system around an inside corner of said wall and the means for extending said baseboard support form system around an outside corner of said wall, are each made in one preformed piece.

6. The baseboard support form system of claim 5 wherein the preformed piece forming the means for extending said baseboard support form system around an inside corner of said wall and the means for extending said baseboard support form system around an outside corner of said wall, has a joint formed at a right angle.

7. The baseboard support form system of claim 5 wherein the preformed piece, forming the means for extending said baseboard support form system around an inside corner of said wall and the means for extending said baseboard support form system around an outside corner of said wall, includes a straight body having two ends wherein the two ends are miter cut at 45 degree angles.

* * * * *